US009067424B1

(12) United States Patent
Tominaga et al.

(10) Patent No.: US 9,067,424 B1
(45) Date of Patent: Jun. 30, 2015

(54) INK CARTRIDGE AND MOUNT/DEMOUNT MECHANISM FOR THE SAME

(71) Applicant: RISO KAGAKU CORPORATION, Tokyo (JP)

(72) Inventors: Hirotaka Tominaga, Ibaraki (JP); Norihisa Shimamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/151,431

(22) Filed: Jan. 9, 2014

(30) Foreign Application Priority Data

Jan. 9, 2014 (JP) ..... 2014-002093

(51) Int. Cl.
*B41J 2/175* (2006.01)

(52) U.S. Cl.
CPC ..... *B41J 2/17523* (2013.01)

(58) Field of Classification Search
USPC ..... 347/7, 66, 84, 85, 86, 49
See application file for complete search history.

(56) References Cited

U.S. PATENT DOCUMENTS 5,583,549 A * 12/1996 Ujita et al. ..... 347/86
5,784,088 A * 7/1998 Ujita et al. ..... 347/86
6,158,849 A * 12/2000 Veciana et al. ..... 347/85
6,582,068 B2 * 6/2003 Ishizawa et al. ..... 347/85
6,863,388 B2 * 3/2005 Seino et al. ..... 347/86
7,854,499 B2 12/2010 Udagawa
8,197,042 B2 6/2012 Akiyama

FOREIGN PATENT DOCUMENTS

JP 2008-36908 A 2/2008
JP 2010-69806 A 4/2010

OTHER PUBLICATIONS

Office Action cited in Japanese Application No. 2014-002093 dated Jan. 28, 2014.
Office Action cited in Japanese Application No. 2014-002093 dated Feb. 25, 2014.

* cited by examiner

*Primary Examiner* — Anh T. N. Vo
(74) *Attorney, Agent, or Firm* — Greenblum & Bernstein, P.L.C.

(57) ABSTRACT

An ink cartridge includes: an ink storage container configured to store ink; a socket portion provided at one end of the ink storage container and configured to be fitted to and detached from a joint portion of a printing machine; an ink supply port provided in the socket portion; an inside plug configured to seal an ink passage to the ink supply port by using a biasing force coming from a direction of the ink storage container; and an inside plug lock portion configured to lock the inside plug at a position where the inside plug is pressed by an insertion shaft, and maintain a locked state of the inside plug independently of a retreating of the insertion shaft to a retreat position after a locking of the inside plug.

8 Claims, 7 Drawing Sheets

INSERTION SHAFT DRIVE MECHANISM
JOINT BODY DRIVE MECHANISM
60
IK
56b
53d
56
60a
56a
61
62
55
53e
53c
54
53b
X2
53a1
53a
53
51af
51e
51f
51g
51h
51a
51b
51c
51d
51i
51j
50
51
37
37a
32a
36
35
31a
34a
34c
34
34b
31e
X1
31b
33
31c
31f
30
31g
31d
31
32
12
11
32a
31g
31f

INK CARTRIDGE AND MOUNT/DEMOUNT MECHANISM FOR THE SAME

CROSS REFERENCE TO RELATED APPLICATION

This application is based upon and claims the benefit of priority from the prior Japanese Patent Application No. 2014-002093, filed on Jan. 9, 2014, the entire contents of which are incorporated herein by reference.

BACKGROUND

1. Technical Field

The present invention relates to an ink cartridge and an ink cartridge mount/demount mechanism which are configured such that a socket portion provided in the ink cartridge is detachably fitted to a joint portion provided in a printing machine.

2. Related Art

Generally, an inkjet printing machine employing an inkjet method uses multiple ink cartridges respectively storing inks of colors such for example as yellow (Y), magenta (M), cyan (C), and black (K).

A socket portion provided in each of the ink cartridges is detachably fitted to a joint portion provided in the inkjet printing machine and the ink in the ink cartridge is thereby supplied from the socket portion to the inkjet printing machine via the joint portion.

Moreover, the inkjet printing machine can perform color printing of images and characters on paper sheets by supplying the inks from the ink cartridges of the respective colors to inkjet heads provided for the respective ink colors and by ejecting the inks of the respective colors to the paper sheets from the inkjet heads of the respective colors. The inkjet printing machine is thus widely used as a printing machine for home and business use. Moreover, the inkjet printing machine is configured to perform monochrome printing by using only the ink of one color of black (K).

Along with recent increase in the speed of printing on paper sheets and the sizes of images, the amounts of inks consumed in the inkjet printing machine have increased.

In order to increase the amount of ink supplied from the ink cartridge to the inkjet printing machine (hereafter, simply referred to as printing machine), the applicant has proposed before an ink cartridge mount/demount mechanism which can detachably attach an ink cartridge to a printing machine, the ink cartridge including an ink supply port which is used to supply ink to the printing machine and which is formed to have a diameter larger than that of an insertion shaft provided to the printing machine (see Japanese Patent Application Publication No. 2010-69806).

Although illustration herein is omitted, in the ink cartridge mount/demount mechanism described above, the ink cartridge is detachably connected to a joint portion provided in the printing machine, in a substantially horizontal direction.

The ink cartridge described above includes a socket portion configured to be detachably fitted to the joint portion in the printing machine and an ink storage container storing the ink is attached to a rear end of the socket portion.

In the socket portion of the ink cartridge, the ink supply port is opened on the distal end side of a socket body and the socket body is provided with an inside plug movable relative to the ink supply port in front-rear directions.

In the socket body, an O-ring is fitted between the ink supply port and a distal end circular protruding portion formed in the inside plug. The inside plug to which the O-ring is fitted is moved forward to the ink supply port and thereby prevents leakage of the ink from the ink cartridge not in use.

In the joint portion in the printing machine, an insertion shaft to be inserted into and removed from the ink supply port of the socket body is formed in a center portion of the joint body integrally with the joint body. The insertion shaft has a diameter smaller than the hole diameter of the ink supply port. In addition, an ink flow-in passage allowing the ink to flow from the ink cartridge is formed around the insertion shaft.

In the joint portion main body, an ink leakage preventing member is slidably fitted to the insertion shaft. When the insertion shaft is inserted to the ink supply port, the ink leakage preventing member is moved forward in the insertion direction in the joint body to prevent leakage of the ink having flowed into the joint body by spring force.

When the ink cartridge is connected to the printing machine, the insertion shaft formed in the center portion of the joint body is inserted into the ink supply port of the socket body and pushes and moves the inside plug toward an opposite side of the socket body from the ink supply port side.

With the inside plug pushed, an ink flow-out passage through which the ink flows toward the ink supply port is formed in the socket body. Accordingly, a large amount of ink can flow from the ink supply port into the joint portion of the printing machine.

SUMMARY

In the ink cartridge mount/demount mechanism described above, when the socket portion of the ink cartridge is fitted to the joint portion in the printing machine, the ink in the socket body flows into the joint portion through a gap formed between the ink supply port and the insertion shaft because the insertion shaft in the joint body is formed to have the diameter smaller than the hole diameter of the ink supply port of the socket body as described above.

However, the insertion shaft inserted into the ink supply port hinders the ink supply from the socket portion to the joint portion, and reduces the ink flow amount by an amount corresponding to the cross-sectional area of the insertion shaft. To compensate this, the ink flow amount may be increased by increasing the diameter of the ink supply port, but this leads to increase in the size of the ink cartridge.

An object of the present invention is to provide an ink cartridge and an ink cartridge mount/demount mechanism in which an insertion shaft provided in a center portion of a joint body does not hinder an ink supply port of a socket body from supplying an ink from a socket portion in the ink cartridge to a joint portion in a printing machine.

An ink cartridge in accordance with some embodiments includes: an ink storage container configured to store ink; a socket portion provided at one end of the ink storage container and configured to be fitted to and detached from a joint portion of a printing machine; an ink supply port provided in the socket portion; an inside plug configured to seal an ink passage to the ink supply port by using a biasing force coming from a direction of the ink storage container; an insertion shaft capable of advancing and retreating between a pressing position and a retreat position, the pressing position being a position where the insertion shaft presses the inside plug against the biasing force and thereby unseals the ink passage when the socket portion and the joint portion are fitted to each other, the retreat position being a position where the insertion shaft retreats to outside of the ink supply port; and an inside plug lock portion configured to lock the inside plug at a position where the inside plug is pressed by the insertion shaft, and maintain a locked state of the inside plug independently of a retreating of the insertion shaft to the retreat position after a locking of the inside plug.

The configuration described above particularly includes the inside plug lock portion configured to lock the inside plug at the position where the inside plug is pressed by the insertion shaft at the pressing position in the joint portion, against the biasing force from the ink storage container side, when the socket portion in the ink cartridge and the joint portion in the printing machine are fitted to each other, and to maintain the locked state of the inside plug even if the insertion shaft retreats to the retreat position outside the ink supply port after the locking of the inside plug. Accordingly, the insertion shaft does not hinder the ink supply port from supplying the ink from the socket portion to the joint portion and a large amount of ink on the socket portion side can flow from the ink supply port into the joint portion. In this configuration, it is possible to reduce an ink supply time without increasing the size of the ink cartridge and to thereby print image information on many paper sheets at high speed in the printing machine.

The inside plug lock portion may be configured to release the locked state of the inside plug upon the inside plug in the locked state being pressed again, and before the ink cartridge is pulled out from the printing machine, the ink passage may be sealed with the inside plug by moving the insertion shaft to the pressing position to unlock the inside plug, and then by moving the insertion shaft toward the retreat position.

In the configuration described above, particularly, before the ink cartridge is pulled out from the printing machine, the ink passage is sealed with the inside plug by moving the insertion shaft to the pressing position to unlock the inside plug, and then by moving the insertion shaft toward the retreat position. Accordingly, the ink on the socket portion side does not leak from the ink supply port and the amount of ink which may drip between the joint portion and the socket portion can be suppressed to the minimum. Hence, it is possible to suppress the dripping of the ink from the ink supply port which occurs when the fitting between the joint portion and the socket portion is released. The ink cartridge can be thus carried at ease after being detached from the printing machine.

An ink cartridge mount/demount mechanism in accordance with some embodiments includes: a joint portion provided in a printing machine; and a socket portion provided on a distal end side of an ink cartridge, the joint portion and the socket portion configured such that the socket portion is detachably fitted to the joint portion and ink in an ink storage container attached to a rear end side of the socket portion is supplied to the printing machine from the socket portion via the joint portion. The joint portion includes: a joint body provided to face the socket portion; and an insertion shaft capable of advancing and retreating between a pressing position of pressing the socket portion by protruding forward in the joint body and a retreat position retreating to a position rearward of the pressing position. The socket portion includes: a socket body including an ink supply port on a side of the socket body facing the joint body; an inside plug housed in the socket body to seal an ink passage to the ink supply port by using a biasing force coming from a direction of the ink storage container and configured to unseal the ink passage by staying at a position where the inside plug is pressed by the insertion shaft at the pressing position against the biasing force when the socket portion is fitted to the joint body; and an inside plug lock portion configured to lock the inside plug at the position where the inside plug is pressed by the insertion shaft, and maintain a locked state of the inside plug independently of a retreating of the insertion shaft to the retreat position outside the ink supply port after a locking of the inside plug.

In the configuration described above, in order to detachably fit the socket portion provided on the distal end side of the ink cartridge to the joint portion provided in the printing machine, the joint portion includes the joint body and the insertion shaft and the socket portion includes the socket body, the inside plug, and the inside plug lock portion. In this case, particularly, the inside plug lock portion locks the inside plug at the position where the inside plug is pressed by the insertion shaft at the pressing position in the joint portion and maintains the locked state of the inside plug even if the insertion shaft retreats to the retreat position outside ink supply port after the locking of the inside plug. As a result, the insertion shaft does not hinder the ink supply port from supplying the ink from the socket portion to the joint portion, and a large amount of ink on the socket body side can flow to the joint body side from the ink supply port. In this configuration, it is possible to reduce an ink supply time without increasing the sizes of the printing machine and the ink cartridge and to thereby print image information on many paper sheets at high speed in the printing machine.

The inside plug lock portion may be configured to release the locked state of the inside plug upon the inside plug in the locked state being pressed again, and before the ink cartridge is pulled out from the printing machine, the ink passage may be sealed with the inside plug by moving the insertion shaft to the pressing position to unlock the inside plug, and then by moving the insertion shaft in a direction toward the retreat position.

In the configuration described above, particularly, before the ink cartridge is pulled out from the printing machine, the ink passage is sealed with the inside plug by moving the insertion shaft to the pressing position to unlock the inside plug, and then by moving the insertion shaft to the retreat position. Accordingly, effects similar to those of the configurations described above can be obtained.

DETAILED DESCRIPTION

Figure 1:
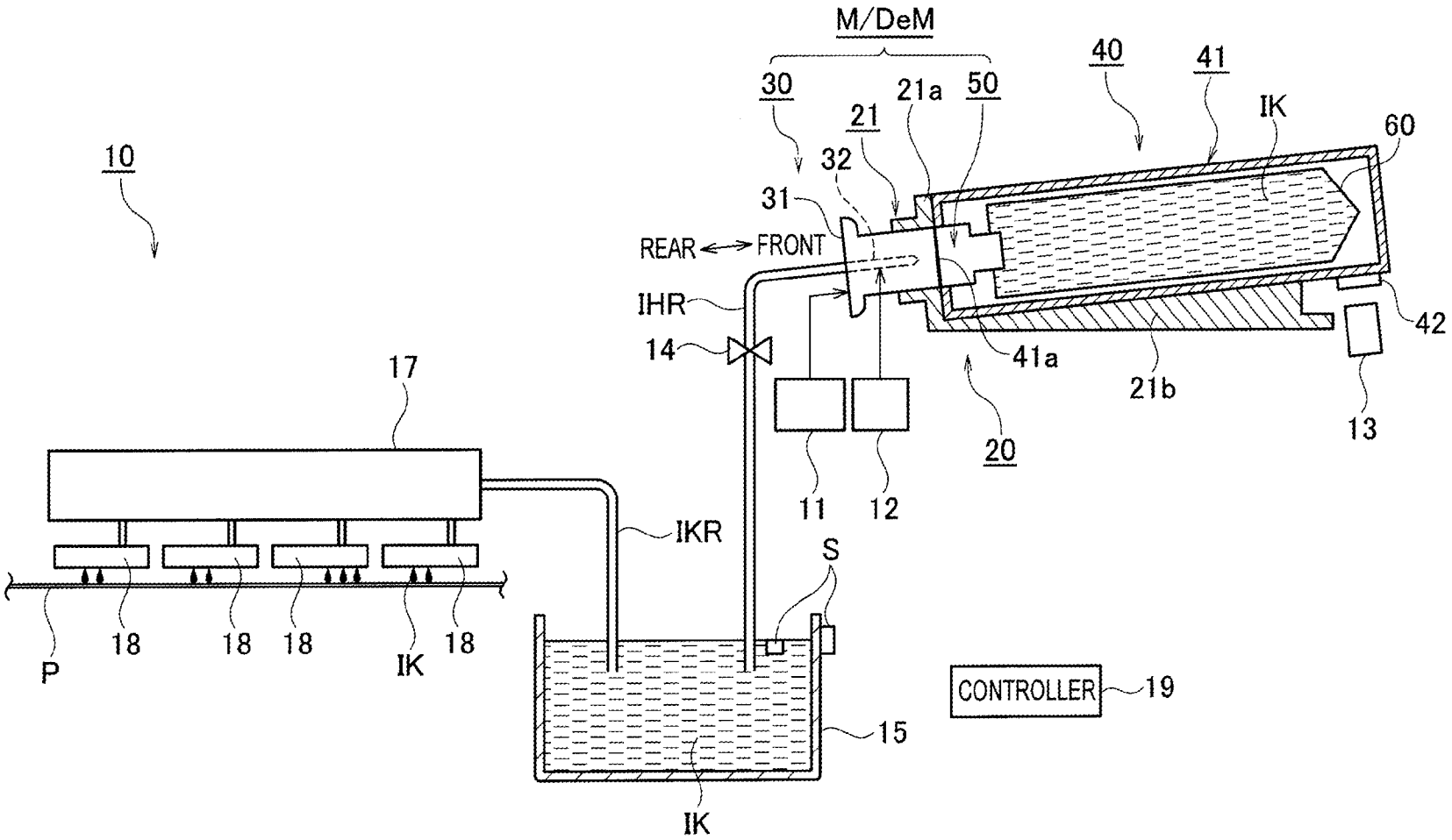
FIG. 1 is a configuration diagram showing a schematic configuration of an inkjet printing machine to which an ink cartridge and an ink cartridge mount/demount mechanism in an embodiment of the present invention are applied.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

An ink cartridge and an ink cartridge mount/demount mechanism in an embodiment of the present invention are described below in detail with reference to FIGS. 1 to 7(*d*).

The ink cartridge and the ink cartridge mount/demount mechanism in the embodiment of the present invention are applied to a well-known inkjet printing machine.

Here, a socket portion provided in the ink cartridge is detachably fitted to a joint portion provided in the inkjet printing machine so that an ink housed in an ink storage container of the ink cartridge can be supplied from the socket portion to the inkjet printer machine via the joint portion.

Moreover, in the ink cartridge and the ink cartridge mount/demount mechanism in the embodiment of the present invention, particularly, an insertion shaft is provided in a center portion of a joint body of the joint portion to be movable in front-rear directions relative to the socket portion. In addition, an inside plug is provided in a socket body of the socket portion to be movable in the front-rear directions and is capable of being locked and unlocked by an operation of the insertion shaft pressing the inside plug.

Before giving description of the ink cartridge and the ink cartridge mount/demount mechanism in the embodiment of the present invention, an inkjet printing machine to which the ink cartridge and the ink cartridge mount/demount mechanism in the embodiment of the present invention are applied is briefly described by using FIG. 1.

FIG. 1 shows a schematic configuration of the inkjet printing machine to which the ink cartridge and the ink cartridge mount/demount mechanism in the embodiment of the present invention are applied.

As shown in FIG. 1, in the inkjet printing machine (hereafter, simply referred to as printing machine) 10, a cartridge attachment mechanism 20 forming part of an ink cartridge mount/demount mechanism M/DeM (Mount/DeMount) in the embodiment of the present invention is installed in an upper portion of the printing machine 10.

Moreover, a socket portion 50 provided in an ink cartridge 40 in the embodiment of the present invention is detachably connected to a joint portion 30 supported by a holder 21 of a cartridge attachment mechanism 20 provided in the printing machine 10.

The ink cartridge mount/demount mechanism M/DeM in the embodiment of the present invention includes the joint portion 30 provided in the printing machine 10 and the socket portion 50 provided in the ink cartridge 40 which is detachably fitted to the joint portion 30.

Moreover, an ink IK in the ink cartridge 40 is supplied to the printing machine 10 when the socket portion 50 is fitted to the joint portion 30.

In this case, in the holder 21 of the cartridge attachment mechanism 20, a cartridge mounting table 21*b* is formed integrally with a front plate 21*a* to be continuously connected to a lower portion of the front plate 21*a*. The ink cartridge 40 is mounted on the cartridge mounting table 21*b* while being inclined at about 2° so that the ink IK can flow toward the printing machine 10.

Moreover, as will be described later, after the ink cartridge 40 is connected to the cartridge attachment mechanism 20, a joint body 31 of the joint portion 30 supported by the front plate 21*a* of the holder 21 can be linearly moved in the front-rear directions, relative to the socket portion 50 in the ink cartridge 40, by a joint body drive mechanism 11 provided in the printing machine 10.

Furthermore, an insertion shaft 32 provided in a center portion of the joint body 31 can be linearly moved in the front-rear directions, relative to the socket portion 50 in the ink cartridge 40, independently of the joint body 31 by an insertion shaft drive mechanism 12 provided in the printing machine 10.

Meanwhile, in the ink cartridge 40 in the embodiment of the present invention, the socket portion 50 is disposed in a rectangular-solid outer case 41 to extend toward a front surface 41*a* of the outer case 41 and an ink storage container 60 storing the oil-based ink IK is attached to a rear end of the socket portion 50.

Moreover, an IC tag 42 is attached to the outer case 41 and an IC tag receiver 13 is installed in the printing machine 10 to face the IC tag 42. The IC tag receiver 13 can wirelessly receive color information and the like of the ink IK stored in the IC tag 42.

For example, multiple ink cartridges 40 respectively storing the inks IK of many colors such as yellow (Y), magenta (M), cyan (C), and black (K) are installed in the printing machine 10. However, illustration and description of only one ink cartridge 40 is given below.

The ink IK from the ink cartridge 40 described above is put into an ink tank 15 from the socket portion 50 through an ink supplementation passage IHR via the joint portion 30 of the printing machine 10, by an on-off operation of a solenoid on-off valve 14.

Moreover, the ink tank 15 is provided with a liquid level sensor S configured to measure the amount of ink IK put into the ink tank 15. The on-off of the solenoid on-off valve 14 is controlled by a controller 19 to be described later, depending on a detection result of the liquid level sensor S.

The supply of the ink IK from the ink cartridge 40 to the ink tank 15 is performed by using a pressure difference between the ink cartridge 40 disposed at a higher position and the ink tank 15 disposed at a lower position.

Thereafter, the ink IK put into the ink tank 15 is sent to an ink distributor 17 through an ink supply passage IKR and is distributed to multiple inkjet heads 18 by the ink distributor 17. Images and characters can be printed on a paper sheet P by ejecting the ink IK to the paper sheet P from the multiple inkjet heads 18.

Furthermore, the controller 19 configured to control the entire machine is installed at an appropriate position in the printing machine 10.

Figure 2:
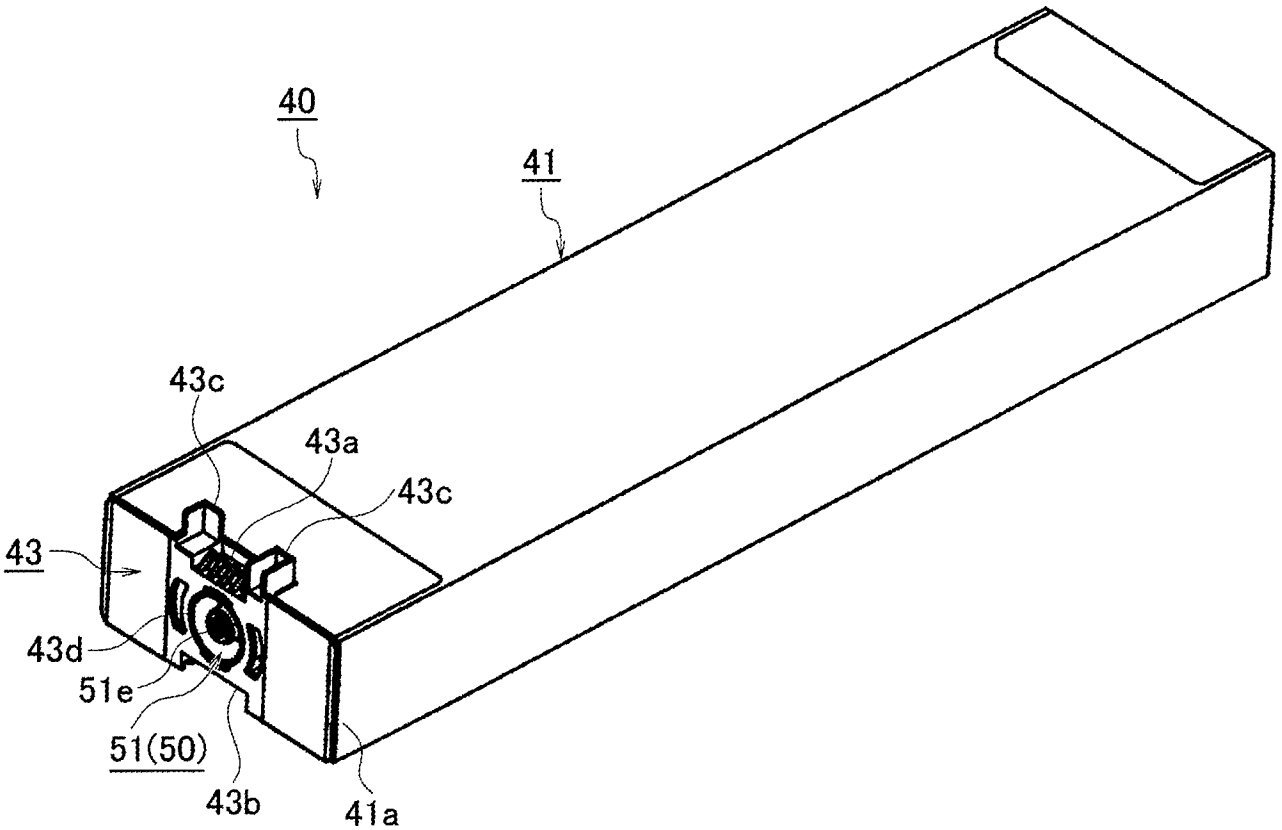
FIG. 2 is a perspective view showing an external shape of the ink cartridge in the embodiment of the present invention.
Figure 3A:
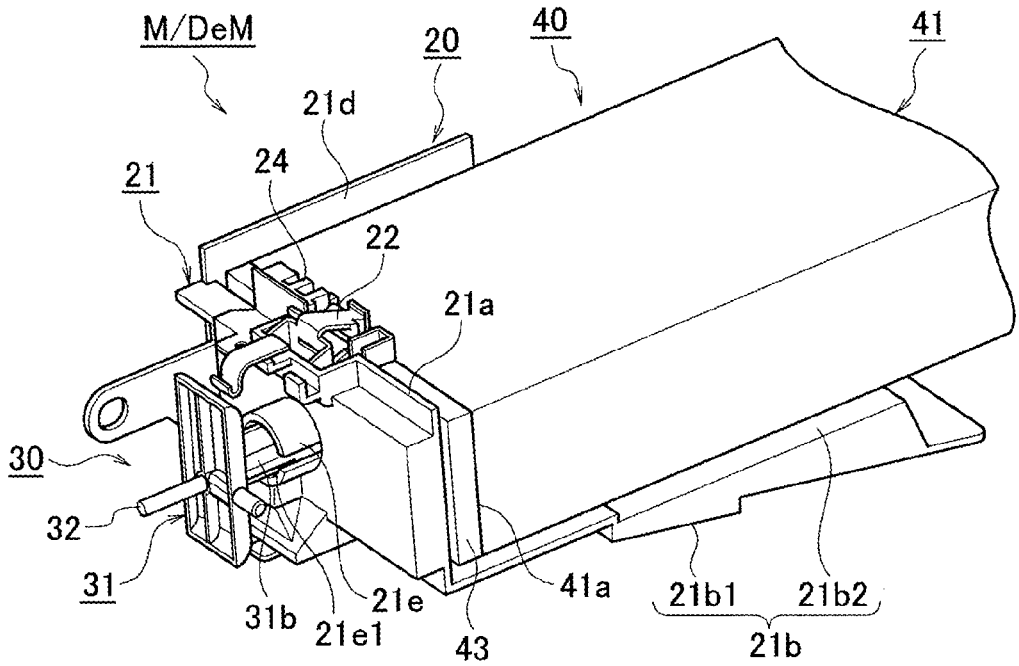
FIG. 3A is a perspective view showing a state where the ink cartridge in the embodiment of the present invention is to be connected to a cartridge attachment mechanism in the printing machine.
Figure 3B:
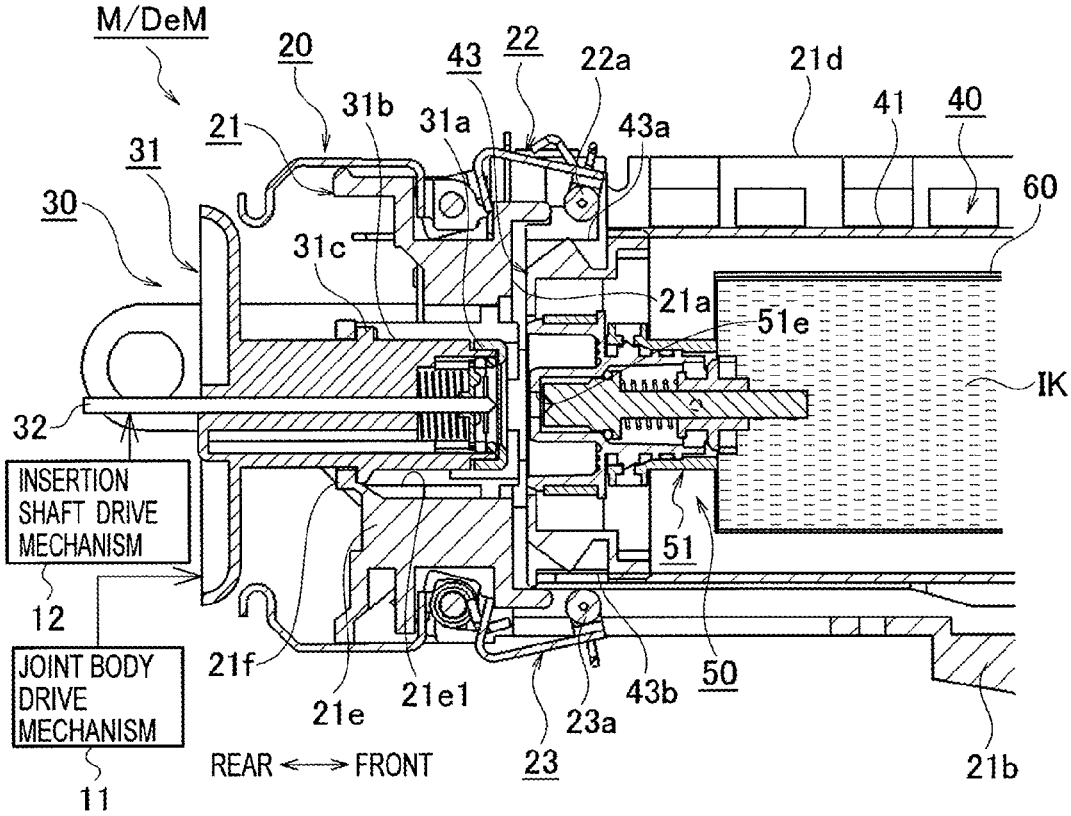
FIG. 3B is a vertical cross-sectional view showing the state where the ink cartridge in the embodiment of the present invention is to be connected to the cartridge attachment mechanism in the printing machine.

Next, configurations of the ink cartridge 40 and the ink cartridge mount/demount mechanism M/DeM in the embodiment of the present invention are described by using FIGS. 2 to 3B.

FIG. 2 shows a perspective view of an external shape of the ink cartridge in the embodiment of the present invention. Moreover, FIGS. 3A and 3B show a state where the ink cartridge in the embodiment of the present invention is to be connected to the cartridge attachment mechanism in the printing machine.

Ink Cartridge 40

First, as shown in FIG. 2, in the ink cartridge 40, the outer case 41 is formed by using a paper material or the like, in a box shape with a ratio between a vertical dimension in a vertical direction and a horizontal dimension in a horizontal direction being set to about 1:2.

Furthermore, a connection member 43 made of a stiff plate material such as a resin material or a metal material is attached to the front surface 41*a* side of the outer case 41 and is thereby unified with the outer case 41.

The connection member 43 described above has a function of connecting the ink cartridge 40 to the printing machine 10 (FIG. 1) and a function of connecting the socket portion 50 in the ink cartridge 40.

Lock recess portions 43*a*, 43*b* configured to be connected to the cartridge attachment mechanism 20 of the printing machine 10 (FIG. 1) are formed in center portions of upper and lower outer sides of the connection member 43.

Furthermore, a pair of protruding portions 43*c*, 43*c* are formed to protrude respectively on both sides of the lock recess portion 43*a* in the upper outer side of the connection member 43. The pair of protruding portions 43*c*, 43*c* are detected by a cartridge attachment sensor 24 (FIG. 3A) attached to an upper portion of the front plate 21*a* of the holder 21.

Moreover, a center portion of the connection member 43 is provided with a round hole 43*d* formed to penetrate the connection member 43. The socket portion 50 is inserted in the round hole 43*d* in a manner visible from outside, and a later-described ink supply port 51*e* formed in a socket body 51 of the socket portion 50 is exposed toward the printing machine 10 (FIG. 1).

The ink supply port 51*e* described above is configured such that the ink supply port 51*e* is opened to have a large diameter of, for example, about ϕ 3 mm and that a large amount of ink IK (FIG. 1) can be supplied to the printing machine 10 from the ink supply port 51*e* formed to have a large diameter.

In the ink cartridge 40, the socket portion 50 is disposed to face the joint portion 30 (FIG. 1) in the printing machine 10. Moreover, the ink storage container 60 (FIG. 3B) formed in a bag shape by using a film material is attached to a rear portion of the socket body 51 of the socket portion 50 by heat sealing. The socket portion 50 is thus provided at one end of the ink storage container 60 which is a front end.

Cartridge Attachment Mechanism 20

Next, as shown in FIGS. 3A and 3B, in a case where the ink cartridge 40 is connected to the cartridge attachment mechanism 20 in the printing machine 10 (FIG. 1), in the cartridge attachment mechanism 20, the holder 21 which is a base made of a resin material is formed as a stiff frame body integrally including: the substantially-vertical front plate 21*a*; the cartridge mounting table 21*b* horizontally provided to be continuously connected to the lower portion of the front plate 21*a*; and a pair of left and right side plates (21*c*, not illustrated), 21*d* vertically provided to be continuously connected to left and right portions of the front plate 21*a*.

In a center portion of the front plate 21*a* of the holder 21 described above, an annular portion 21*e* having a through hole 21*e*1 with guide grooves is formed to protrude toward a rear side which is the opposite side to the ink cartridge 40 side.

Moreover, first and second outer periphery cylinder portions 31*a*, 31*b* formed in the joint body 31 of the joint portion 30 are fitted into and supported by the through hole 21*e*1 with guide grooves of the annular portion 21*e* of the holder 21 to be slidable in the front-rear directions.

In this case, a stopper 21*f* configured to prevent the joint body 31 from falling out from the through hole 21*e*1 with guide grooves of the annular portion 21*e* is provided integrally in a rear end of the annular portion 21*e* of the holder 21. A later-described outer periphery protruding portion 31*c* formed in the joint body 31 is brought into contact with and moved away from the stopper 21*f*.

Moreover, in the cartridge mounting table 21*b* of the holder 21, a bottom surface 21*b*1 is formed to be horizontal and an inclined surface 21*b*2 is formed above the bottom surface 21*b*1 to be inclined at about 2° in such a way that the height of the inclined surface 21*b*2 becomes lower toward the front plate 21*a*.

When the ink cartridge 40 is mounted on the inclined surface 21*b*2 of the cartridge mounting table 21*b*, the ink IK in the ink cartridge 40 flows toward the joint portion 30.

Furthermore, lock members 22, 23 which are formed by attaching rollers 22*a*, 23*a* respectively to one ends of flat spring materials and which elastically deform are provided in upper and lower portions of the holder 21. The lock recess portions 43*a*, 43*b* are formed in upper and lower portions of the connection member 43 to face the lock members 22, 23, the connection member 43 provided on the front surface 41*a* side of the outer case 41 of the ink cartridge 40.

The ink cartridge 40 is connected by being manually pushed toward the holder 21 of the cartridge attachment mechanism 20. At this time, the rollers 22*a*, 23*a* of the lock members 22, 23 provided in the upper and lower portions of the holder 21 are fitted into the lock recess portions 43*a*, 43*b* of the connection member 43 provided in the ink cartridge 40. The ink cartridge 40 is thereby connected to the holder 21. Moreover, the connection state of the ink cartridge 40 is detected by using the cartridge attachment sensor 24 attached to the upper portion of the holder 21 and the protruding portions 43*c* (FIG. 2) of the connection member 43.

Meanwhile, when the ink cartridge 40 is manually pulled out from the holder 21, the connection with the holder 21 is released.

Furthermore, as will be described in the below-mentioned operation, when the ink cartridge 40 is pushed toward the holder 21 of the cartridge attachment mechanism 20 and is thereby connected to the holder 21, the joint portion 30 and the socket portion 50 face each other with a small gap therebetween.

After the connection, the joint body 31 of the joint portion 30 can be linearly moved in the front-rear directions relative to the socket portion 50 in the ink cartridge 40 by the joint body drive mechanism 11 provided in the printing machine 10 (FIG. 1).

Furthermore, after the connection, the insertion shaft 32 provided in the center portion of the joint body 31 can be linearly moved in the front-rear directions relative to the socket portion 50 by the insertion shaft drive mechanism 12 provided in the printing machine 10 (FIG. 1).

Due to this configuration, the joint portion 30 and the socket portion 50 are fitted to each other only in the case where the ink cartridge 40 and the holder 21 are connected to each other.

The reason for this is as follows. As described above by using FIG. 1, the joint portion 30 needs to be fitted to the socket portion 50 after the color information of the ink IK outputted from the IC tag 42 attached to the outer case 41 of the ink cartridge 40 is received by the IC tag receiver 13 and the color of the ink IK of the ink cartridge 40 is checked to be correct.

Here, in a case where the joint portion 30 formed in a plug shape is referred to as a male plug portion while the socket portion 50 formed in a socket shape is referred to as a female socket portion, the male plug portion (30) and the female socket portion (50) are male-female matched to each other.

By using FIGS. 4A to 4D and FIGS. 5A and 5B, description is given of the joint portion 30 in the printing machine 10 and the socket portion 50 in the ink cartridge 40 which form a main portion of the embodiment.

Figures 4A, 4B, 4C, 4D:
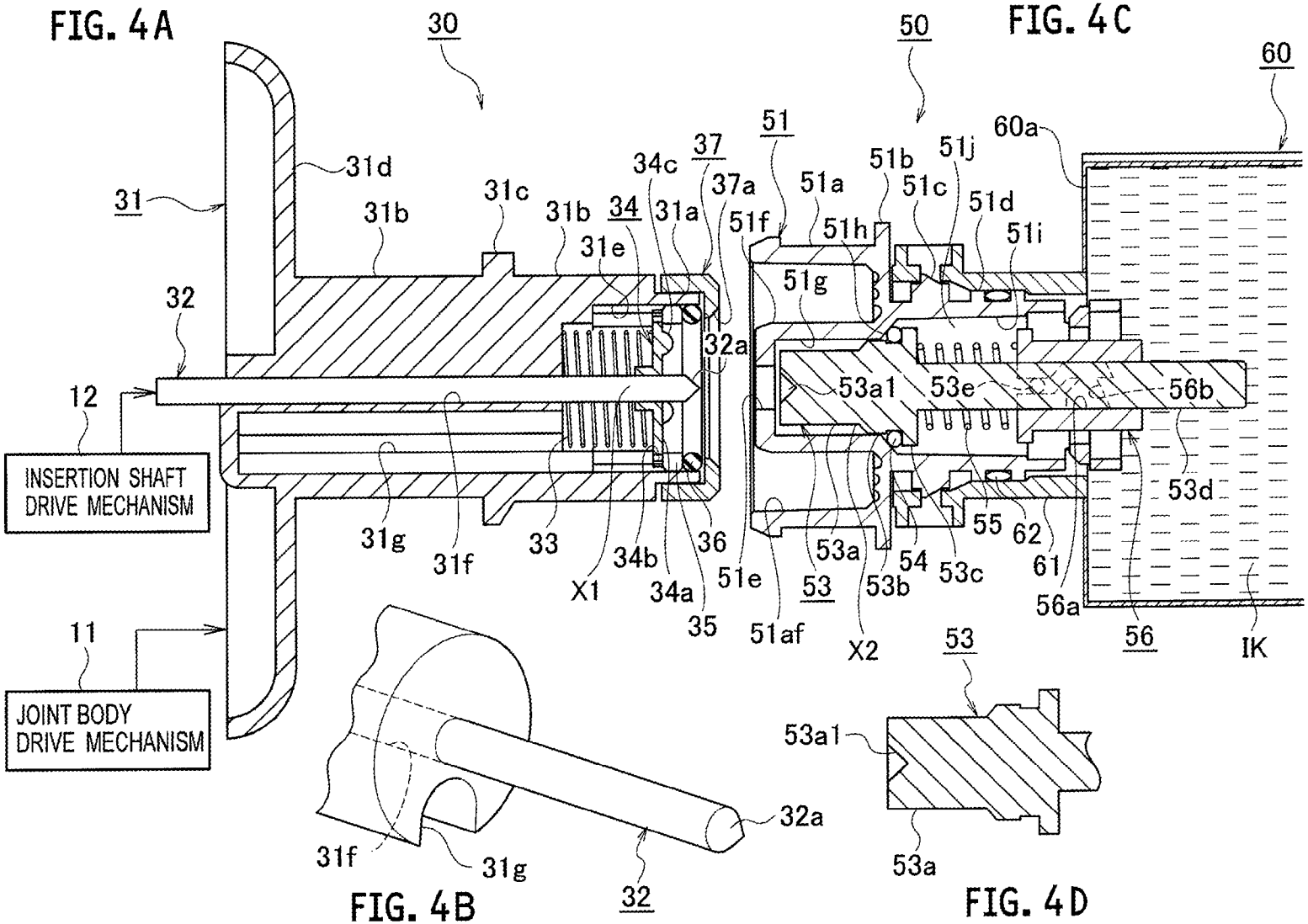
FIGS. 4A to 4D are views showing, in an enlarged manner, a joint portion in the printing machine and a socket portion in the ink cartridge which is to be fitted to the joint portion.
Figures 5A, 5B:
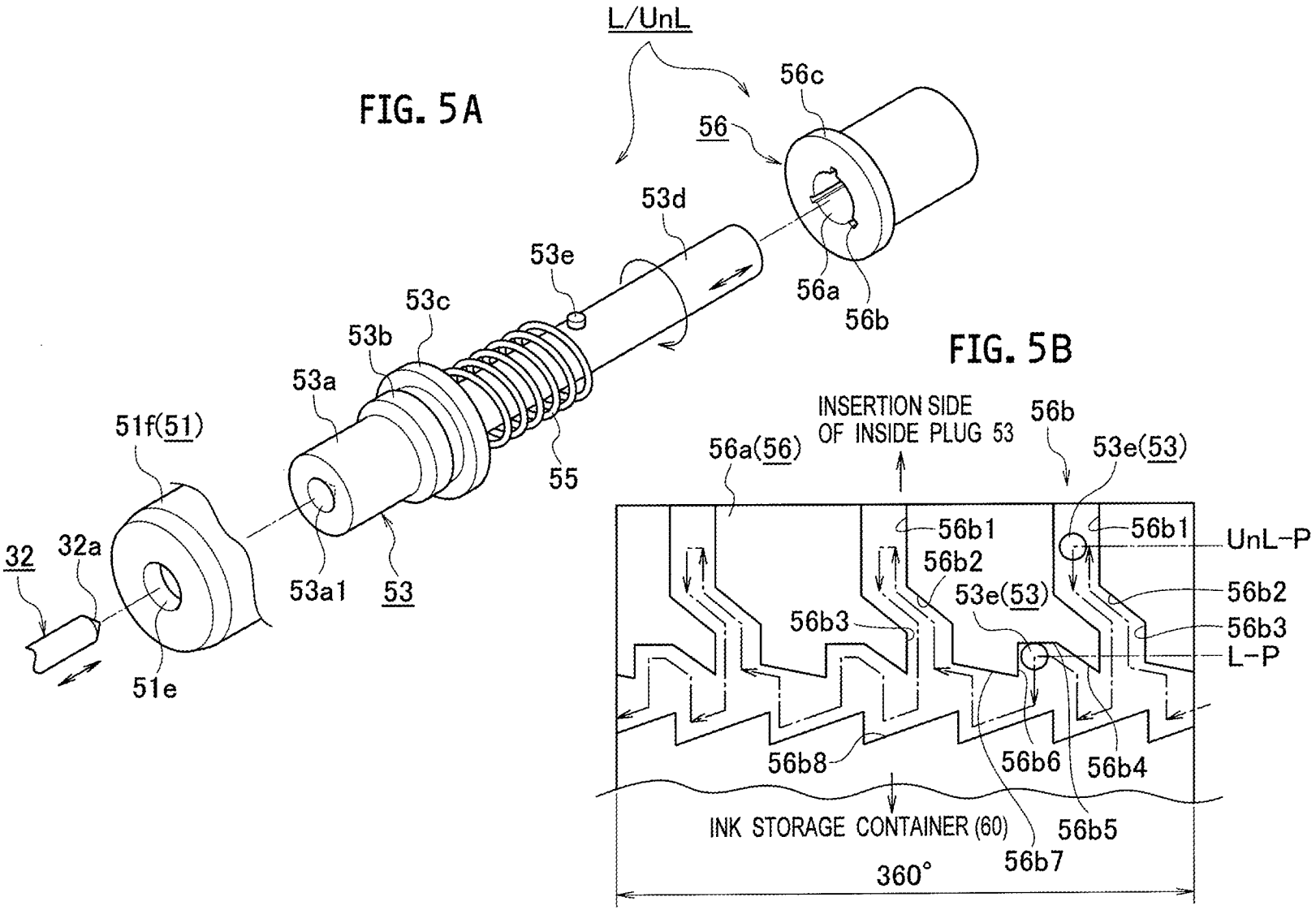
FIG. 5A is a perspective view showing an inside plug lock/unlock portion.
FIG. 5B is an enlarged view showing knock cam sections in the inside plug lock/unlock portion.

FIGS. 4A to 4D show, in an enlarged manner, the joint portion in the printing machine and the socket portion in the ink cartridge which is to be fitted to the joint portion. FIG. 4B is an enlarged view of the X1 portion of FIG. 4A. FIG. 4D is an enlarged view of the X2 portion of FIG. 4C. Moreover, FIG. 5A is a perspective view of an inside plug lock/unlock portion and FIG. 5B is an enlarged view of knock cam sections 56*b*.

Joint Portion 30

As shown in FIG. 4A, in the joint portion 30 provided in the printing machine 10, a side of a cap 37 attached to an outer peripheral portion of a distal end of the joint body 31 is configured as a side to be fitted to the socket portion 50 provided in the ink cartridge 40 to be described later.

Moreover, the joint body 31 which is a base body of the joint portion 30 is formed integrally by using a resin material.

In the joint body 31 described above, the first outer periphery cylinder portion 31*a* is formed in a distal end portion facing the socket portion 50 in the ink cartridge 40. The first outer periphery cylinder portion 31*a* is formed to have such a diameter and a length that the cap 37 can be attached thereto. Moreover, the second outer periphery cylinder portion 31*b* is formed behind the first outer periphery cylinder portion 31*a* to be continuously connected thereto. The second outer periphery cylinder portion 31*b* is formed to have a long length and a diameter larger than that of the first outer periphery cylinder portion 31*a* and about the same as the outer diameter of the cap 37.

Moreover, in the joint body 31, the outer periphery protruding portion 31*c* having a short length is formed to protrude outward in an intermediate portion of the second outer periphery cylinder portion 31*b* having the long length. In addition, a flange portion 31*d* is formed at a rear end of the second outer periphery cylinder portion 31*b*, in a rectangular shape extending vertically to the second outer periphery cylinder portion 31*b* as shown in FIG. 3A.

In this case, when the first and second outer periphery cylinder portions 31*a*, 31*b* of the joint body 31 are moved in the front-rear directions in the through hole 21*e*1 with guide grooves of the annular portion 21*e* of the holder 21 by drive force of the joint body drive mechanism 11 as shown in FIG. 3B mentioned above, the outer periphery protruding portion 31*c* formed in the intermediate portion of the second outer periphery cylinder portion 31*b* functions as a rotation stopper and a movement stopper.

The joint body 31 is maintained at an initial position by the joint body drive mechanism 11 in an initial stage where the joint portion 30 is spaced away from the socket portion 50.

Returning to FIG. 4A, a distal end circular recess portion 31*e* is formed in an inner peripheral portion of the joint body 31 on the distal end side to be recessed in a circular recess shape. In addition, an insertion shaft hole 31*f* is formed in a center portion of the distal end circular recess portion 31*e* to penetrate the joint body 31 and extend in an axial direction toward the flange portion 31*d* on the rear side.

Moreover, the insertion shaft 32 is fitted into the insertion shaft hole 31*f* formed in the center portion of the joint body 31 to be capable of being linearly moved in the front-rear directions, relative to the socket portion 50, by drive force of the insertion shaft drive mechanism 12 provided in the printing machine 10 (FIG. 1).

The aforementioned insertion shaft 32 is formed to face the ink supply port 51*e* of the socket body 51 to be described later and to have a diameter smaller than a hole diameter of the ink supply port 51*e*.

Moreover, as shown in an enlarged manner in FIG. 4B, a distal end sharp portion 32*a* is formed in a conical shape at a distal end of the insertion shaft 32. The distal end sharp portion 32*a* has a shape corresponding to a later-described conical hole 53*a*1 formed in an inside plug 53 housed in the socket body 51, i.e., such a shape that the distal end sharp portion 32*a* after being inserted from the ink supply port 51*e* of the socket body 51 can removably come into contact with the conical hole 53*a*1 and easily press the conical hole 53*a*1.

The insertion shaft 32 is provided to be capable of advancing and retreating between a pressing position and a retreat position in the state where the joint portion 30 and the socket portion 50 are fitted to each other as will be described later in a below-mentioned operation, the pressing position being a position where the distal end sharp portion 32*a* protrudes forward to a position of an O-ring 36 inside the cap 37 to press the inside plug 53 rearward in the socket body 51, the retreat position being a position where the distal end sharp portion 32*a* retreats from the ink supply port 51*e* of the socket body 51 to the outside thereof and moved back to a position rearward of the pressing position in the joint body 31.

Moreover, an ink flow-in passage 31*g* into which the ink IK supplied from the socket body 51 flows is formed throughout a portion of the joint body 31 behind and under the insertion shaft 32 to continuously extend to the flange portion 31*d*.

An annular (ring shaped) space is thus formed between an inner peripheral surface of the distal end circular recess portion 31*e* of the joint body 31 and an outer peripheral surface of the insertion shaft 32 with a small diameter.

Furthermore, a compression spring 33, an ink leakage preventing member 34 provided to be slidable in the front-rear directions along the insertion shaft 32, an O-ring holding member 35, and the O-ring 36 are housed inside the annular (ring shaped) space in the distal end circular recess portion 31*e* of the joint body 31 in this order from the rear side to the distal end side, with the insertion shaft 32 passing through these members 33 to 36.

These members 33 to 36 are formed such that the ink IK supplied from the ink cartridge 40 can be made to flow to the ink flow-in passage 31*g* of the joint body 31.

Specifically, in the ink leakage preventing member 34 slidable along the insertion shaft 32, a circular plate portion 34*a* is formed to have substantially the same diameter as an inner diameter of the distal end circular recess portion 31*e* of the joint body 31, and multiple ink flow-in holes 34*b* are formed in an outer peripheral portion of the circular plate portion 34*a* to penetrate the circular plate portion 34*a*. In addition, three protrusions 34*c* are formed on a front side of the circular plate portion 34*a* at intervals of 120° in a circumferential direction to protrude toward the ink supply port 51*e* of the socket body 51.

Moreover, when the joint portion 30 and the socket portion 50 are fitted to each other, the ink leakage preventing member 34 described above faces an outer surface of the socket body 51 forming the ink supply port 51*e*. Furthermore, the three protrusions 34*c* come into contact with the outer surface forming the ink supply port 51*e* while portions of the ink leakage preventing member 34 other than the three protrusions 34*c* do not come into contact with the outer surface.

When the joint portion 30 and the socket portion 50 are fitted to each other, the ink IK from the ink supply port 51*e* of the socket body 51 flows into a gap formed between the portions of the ink leakage preventing member 34 other than the three protrusions 34*c* and the outer surface forming the ink supply port 51*e*. This ink IK passes through the multiple ink flow-in holes 34*b* formed in the circular plate portion 34*a* of the ink leakage preventing member 34 and eventually flows to the ink flow-in passage 31*g*.

Accordingly, the ink leakage preventing member 34 has a function of preventing the ink IK flowing into a space on the rear side of the ink leakage preventing member 34 through the multiple ink flow-in holes 34*b* from leaking to the socket body 51 side.

Furthermore, the cap 37 having a large-diameter circular hole 37*a* formed in a center portion is attached to the first outer periphery cylinder portion 31*a* of the joint body 31.

Due to this, in the initial stage where the joint portion 30 is spaced away from the socket portion 50, the ink leakage preventing member 34, the O-ring holding member 35, and the O-ring 36 are pressed toward the cap 37 by biasing force of the compression spring 33 housed in the distal end circular recess portion 31*e* of the joint body 31 and the members 33 to 36 are enclosed by the cap 37.

In the initial stage, the insertion shaft drive mechanism 12 maintains the insertion shaft 32 at the initial position (=pressing position) where the distal end sharp portion 32*a* stays at the position of the O-ring 36.

Moreover, the ink supply port 51*e* side of the socket body 51 of the socket portion 50 described below can advance into and retreat from the distal end circular recess portion 31*e* of the joint body 31 and the large-diameter circular hole 37*a* of the cap 37.

Socket Portion 50

As shown in FIG. 4C, in the socket portion 50 provided in the ink cartridge 40, a side of an inner periphery cylinder portion 51*f* and a distal end annular recess portion 51*af* which are formed on a distal end side of the socket body 51 are configured as a side to be fitted to the joint portion 30 provided in the printing machine 10.

Moreover, the socket body 51 which is a base body of the socket portion 50 is formed integrally by using a resin material, like the joint body 31.

In the socket body 51 described above, an outer periphery large-diameter cylinder portion 51*a* is formed in a distal end portion facing the joint body 31 of the joint portion 30, the outer periphery large-diameter cylinder portion 51*a* formed to have a diameter larger than those of the first and second outer periphery cylinder portions 31*a*, 31*b* of the joint body 31 and to have a length large enough to house distal end portions of the first and second outer periphery cylinder portions 31*a*, 31*b*.

Moreover, in the socket body 51, an outer periphery circular protruding portion 51*b* is formed behind the outer periphery large-diameter cylinder portion 51*a* to be continuously connected thereto and to have a larger diameter and a smaller length than the outer periphery large-diameter cylinder portion 51*a*. Furthermore, an outer periphery tapered claw portion 51*c* is formed behind the outer periphery circular protruding portion 51*b* to be continuously connected thereto and to have a small length and an outer diameter which gradually becomes smaller toward a rear end.

Furthermore, in the socket body 51, an outer periphery small-diameter cylinder portion 51*d* is formed behind the outer periphery tapered claw portion 51*c* to be continuously connected thereto and to extend to a position near a front surface 60*a* of the ink storage container 60.

Moreover, in the socket body 51, the inner periphery cylinder portion 51*f* is formed to be capable of advancing into and retreating from the large-diameter circular hole 37*a* of the cap 37 and the distal end circular recess portion 31*e* of the joint body 31, the inner periphery cylinder portion 51*f* having a distal end surface in which the ink supply port 51*e* with a diameter larger than the diameter of the insertion shaft 32 is opened.

Furthermore, the insertion shaft 32 provided in the center portion of the joint body 31 can advance into and retreat from the ink supply port 51*e*, and the distal end annular recess portion 51*af* having the annular (ring-shaped) space is formed on the distal end side of the socket body 51 between the inner peripheral surface of the outer periphery large-diameter cylinder portion 51*a* and the outer peripheral surface of the inner periphery cylinder portion 51*f* to have a recess shape.

Moreover, a first circular recess portion 51*g*, a tapered recess portion 51*h*, and a second circular recess portion 51*i* are formed in a step shape in this order from a rear side of the ink supply port 51*e* of the socket body 51 toward the rear end of the socket body 51, in such a way that the inner diameters of these portions become larger in this order.

The inside plug 53 is housed in the first circular recess portion 51*g*, the tapered recess portion 51*h*, and the second circular recess portion 51*i* of the socket body 51 to be movable between an unlock position and a lock position to be described later.

The inside plug 53 described above is integrally formed of: a first cylinder portion 53*a* facing the ink supply port 51*e* of the socket body 51; a second cylinder portion 53*b* formed behind the first cylinder portion 53*a* to be continuously connected thereto and having a diameter larger than the first cylinder portion 53*a*; a circular protruding portion 53*c* formed behind the second cylinder portion 53*b* to be continuously connected thereto and having a diameter larger than the second cylinder portion 53*b*; and a small-diameter shaft portion 53*d* formed behind the circular protruding portion 53*c* to be continuously connected thereto and having a small diameter and a long length.

Furthermore, as shown in an enlarged manner in FIG. 4D, the conical hole 53*a*1 is formed in a center portion of a distal end surface of the first cylinder portion 53*a* of the inside plug 53 as a bottomed hole. The distal end sharp portion 32*a* of the insertion shaft 32 inserted from the ink supply port 51*e* of the socket body 51 can be brought into contact with and spaced away from the conical hole 53*a*1. The distal end sharp portion 32*a* of the insertion shaft 32 presses the inside plug 53 rearward.

Moreover, as also shown in FIG. 5A, a pin 53*e* which is part of the inside plug lock/unlock portion L/UnL (Lock/UnLock) configured to lock and unlock the inside plug 53 is fixedly attached by press fitting to an outer periphery of an intermediate portion of the small-diameter shaft portion 53*d* of the inside plug 53 in a longitudinal direction thereof with a protruding height of the pin 53*e* being low.

Moreover, an O-ring 54 is fitted to the inside plug 53 from the first and second cylinder portions 53*a*, 53*b* side of the inside plug 53 and brought into contact with a front surface of the circular protruding portion 53*c*.

Furthermore, a compression spring 55 is fitted to the small-diameter shaft portion 53*d* of the inside plug 53. Thereafter, one end of the compression spring 55 is brought into contact with a rear surface of the circular protruding portion 53*c* while the other end of the compression spring 55 is brought into contact with a front surface of a flange portion 56*c* of a bearing member 56 fixedly supported between the inside of the second circular recess portion 51*i* of the socket body 51 and the front surface 60*a* of the ink storage container 60. Then, the small-diameter shaft portion 53*d* is fitted to a shaft hole 56*a* of the bearing member 56.

The inside plug 53 can be thus moved forward by biasing force from the ink storage container 60 side and seal an ink passage to the ink supply port 51*e* of the socket body 51.

Furthermore, in the inside plug 53, the pin 53*e* fixedly attached to the outer periphery of the intermediate portion of the small-diameter shaft portion 53*d* in the longitudinal direction thereof is engaged with one of the knock cam sections 56*b* formed on the inner surface of the shaft hole 56*a* of the bearing member 56.

The aforementioned knock cam sections 56*b* formed on the inner surface of the shaft hole 56*a* of the bearing member 56 are also part of the inside plug lock/unlock portion L/UnL.

As shown in FIG. 5B illustrating an enlarged development view of the inner surface of the shaft hole 56*a* over a range of 360°, three knock cam sections 56*b* are repeatedly and continuously formed at intervals of, for example, 120° along a circumference of the inner surface of the shaft hole 56*a* of the bearing member 56. Here, description is given of one of the three knock cam sections 56*b*.

In the knock cam section 56*b* shown in FIG. 5B, there are formed: a first vertical cam groove 56*b*1 which is open on an insertion side of the inside plug 53 to allow the pin 53*e* fixedly attached to the small-diameter shaft portion 53*d* of the inside plug 53 to be positioned at an unlock position UnL-P and which extends downward to have a groove shape between left and right portions; a rightward-downward-inclined cam groove 56*b*2 which is continuously connected to lower ends of the left and right portions of the first vertical cam groove 56*b*1 and which is inclined rightward and downward; and a second vertical cam groove 56*b*3 which is continuously connected to lower ends of left and right portions of the rightward-downward-inclined cam groove 56*b*2 and which extends downward, the grooves being arranged in the order of description.

Moreover, on the insertion side of the inside plug 53, there are formed: a first leftward-upward-inclined cam 56*b*4 which is continuously connected to a lower left end of the second vertical cam groove 56*b*3 and which is inclined leftward and upward; a horizontal cam 56*b*5 which is continuously connected to an upper end of the first leftward-upward-inclined cam 56*b*4 and which extends horizontally to the left; a vertical cam. 56*b*6 which is continuously connected to a left end of the horizontal cam 56*b*5 and which extends downward; and a second leftward-upward-inclined cam 56*b*7 which is continuously connected to a lower end of the vertical cam 56*b*6 and which is inclined leftward and upward, the cams being arranged in the order of description.

A region defined by the horizontal cam 56*b*5 and the vertical cam 56*b*6 is a lock position L-P where the pin 53*e* fixedly attached to the small-diameter shaft portion 53*d* of the inside plug 53 is locked and held. Moreover, a left end of the second leftward-upward-inclined cam 56*b*7 is continuously connected to a lower right end of the adjacent second vertical cam groove 56*b*3.

Furthermore, a saw tooth cam 56*b*8 is formed on a lower side, which is the ink storage container 60 side, to face lower ends of left and right portions of the second vertical cam groove 56*b*3, the first leftward-upward inclined cam 56*b*4, the horizontal cam 56*b*5, the lower end of the vertical cam 56*b*6, and the second leftward-upward-inclined cam 56*b*7 with a gap provided therebetween. A region of the gap described above is formed in a groove shape.

In this case, the saw tooth cam 56*b*8 restricts a position to which the pin 53*e* moves downward from the lock position L-P in the unlocking of the inside plug 53 locked at the lock position L-P.

In a case where the inside plug 53 is moved forward by the biasing force of the compression spring 55, the pin 53*e* fixedly attached to the small-diameter shaft portion 53*d* of the inside plug 53 has already advanced into the first vertical cam groove 56*b*1 in the knock cam section 56*b* from the beginning and stands by at the unlock position UnL-P set on the insertion side of the inside plug 53, in the first vertical cam groove 56*b*1.

Thereafter, when the pin 53*e* is moved along the knock cam section 56*b* in the shaft hole 56*a* of the fixed bearing member 56 as illustrated by dotted lines, the inside plug 53 moves in the front-rear directions while rotating. The lock position L-P where the pin 53*e* is locked is set on the ink storage container 60 side which is deeper inside than the unlock position UnL-P.

Returning to FIG. 4C, in the bearing member 56, the flange portion 56*c* to which the compression spring 55 comes in contact is formed on the insertion side of the inside plug 53.

When the ink cartridge 40 is not used, the inside plug 53 is moved toward the ink supply port 51*e* of the socket body 51 by the biasing force of the compression spring 55.

At this time, since the O-ring 54 fitted to the second cylinder portion 53*b* of the inside plug 53 is in contact with the circular protruding portion 53*c* of the inside plug 53 and the tapered recess portion 51*h* of the socket body 51, an ink flow-out passage 51*j* formed in the second circular recess portion 51*i* is closed. Accordingly, the ink IK in the ink storage container 60 is prevented from flowing to the ink supply port 51*e*.

Moreover, since a container supporting cylinder body 61 attached to the front surface 60*a* of the ink storage container 60 is fitted to a rear end outer peripheral portion of the socket body 51 via an O-ring 62 and a distal end side of the container supporting cylinder body 61 is engaged with the outer periphery tapered claw portion 51*c* of the socket body 51, ink leakage is also prevented between the socket body 51 and the ink storage container 60.

Next, operations of the ink cartridge 40 and the ink cartridge mount/demount mechanism M/DeM which are configured as described above are described by using FIGS. 1 to 7(*d*), in the order of an operation sequence.

Figure 6:
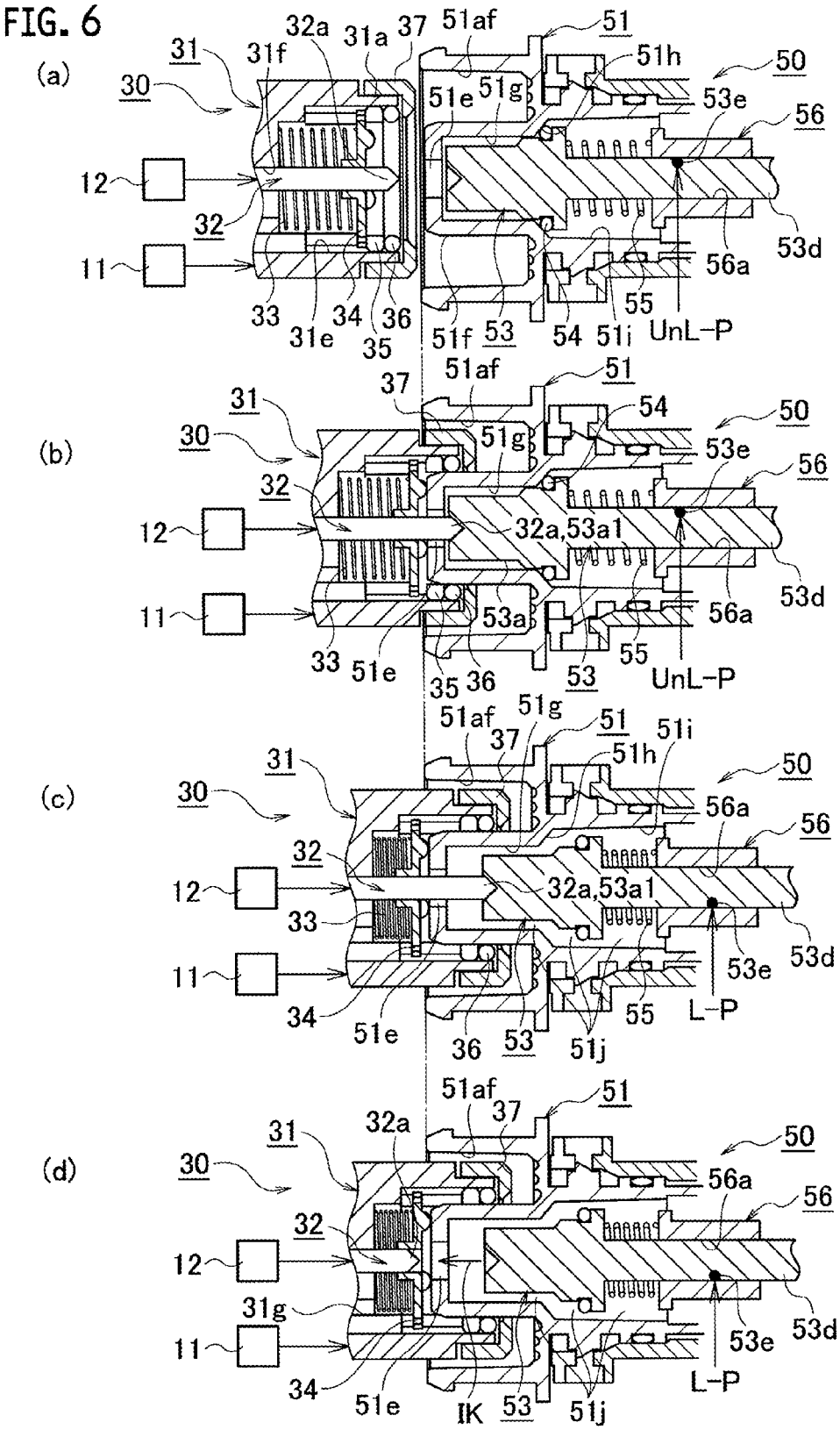
FIGS. 6(*a*) to 6(*d*) are operation views showing an operation sequence of fitting the socket portion in the ink cartridge to the joint portion in the printing machine.

FIGS. 6(*a*) to 6(*d*) show an operation sequence of fitting the socket portion in the ink cartridge to the joint portion in the printing machine. Moreover, FIGS. 7(*a*) to 7(*d*) show an operation sequence of pulling the joint portion in the printing machine out from the socket portion in the ink cartridge.

Note that, in the description of below-mentioned operations, the joint body drive mechanism 11 which moves the joint body 31 of the joint portion 30 in the front-rear directions and the insertion shaft drive mechanism 12 which moves the insertion shaft 32 in the front-rear directions are each pulse-driven by a not-illustrated pulse motor with an initial position being a reference. Moreover, the numbers of pulses from the initial positions respectively of the joint body drive mechanism 11 and the insertion shaft drive mechanism 12 are counted by a not-illustrated counter in the controller 19 to control movement positions of the joint body 31 and the insertion shaft 32.

In this case, the amounts of movement per pulse of the joint body drive mechanism 11 and the insertion shaft drive mechanism 12 are both set to the same value.

Moreover, the controller 19 controls the respective pulse motors (not illustrated) of the joint body drive mechanism 11 and the insertion shaft drive mechanism 12 in such a way that the joint body drive mechanism 11 and the insertion shaft drive mechanism. 12 can be set to a first linear movement mode in which the joint body 31 and the insertion shaft 32 are linearly moved together in the front-rear directions and a second linear movement mode in which only the insertion shaft 32 is linearly moved in the joint body 31 in the front-rear directions.

Operations of Fitting Socket Portion 50 to Joint Portion 30

First, FIG. 6(*a*) shows an initial state just after the ink cartridge 40 is connected to the holder 21 fixedly disposed in the cartridge attachment mechanism 20 and before the joint portion 30 supported by the holder 21 to be movable in the front-rear directions is fitted to the socket portion 50.

In this case, a state where the joint portion 30 is fitted to the socket portion 50 refers to a state where the cap 37 attached to the first outer periphery cylinder portion 31*a* of the joint body 31 advances into the distal end annular recess portion 51*af* of the socket body 51 and the O-ring 36 provided in the joint body 31 is in sliding contact with the inner periphery cylinder portion 51*f* formed on an inner peripheral distal end side of the socket body 51. The state of FIG. 6(*a*) is thus the initial state before the fitting because the O-ring 36 is spaced away from the inner periphery cylinder portion 51*f*.

Then, when the ink cartridge 40 is connected to the holder 21, the IC tag receiver 13 provided in the printing machine 10 receives the color information of the ink IK from the IC tag 42 attached to the outer case 41 of the ink cartridge 40 and the controller 19 provided in the printing machine 10 determines whether the color information of the ink IK matches the holder 21 to which the ink cartridge 40 of the color corresponding to the color information is attached. Accordingly, an error of ink color can be detected beforehand.

Moreover, the joint portion 30 of the printing machine 10 and the socket portion 50 of the ink cartridge 40 face each other with a small gap provided therebetween.

Specifically, on the joint portion 30 side, the joint body drive mechanism 11 configured to move the joint body 31 toward the socket body 51 is stopped at the initial position and set to a standby state.

Moreover, in the distal end circular recess portion 31*e* of the joint body 31, the ink leakage preventing member 34, the O-ring holding member 35, and the O-ring 36 are pressed toward the cap 37 by the biasing force of the compression spring 33.

Furthermore, the insertion shaft 32 fitted into the insertion shaft hole 31*f* of the joint body 31 is located at the pressing position where the distal end sharp portion 32*a* protrudes to the position of the O-ring 36 inside the cap 37 to press the inside plug 53 toward the rear of the socket body 51, and the insertion shaft drive mechanism 12 is stopped at the initial position corresponding to the pressing position of the insertion shaft 32 and set to the standby state.

Meanwhile, on the socket portion 50 side, in the first circular recess portion 51*g*, the tapered recess portion 51*h*, and the second circular recess portion 51*i* of the socket body 51, the inside plug 53 to which the O-ring 54 is fitted is moved toward the ink supply port 51*e* on the front side by the biasing force of the compression spring 55 and plugs the ink supply port 51*e* of the socket body 51.

Moreover, in the initial stage where the small-diameter shaft portion 53*d* of the inside plug 53 is fitted into the shaft hole 56*a* of the bearing member 56 and the inside plug 53 is moved forward in the socket body 51 by the biasing force of the compression spring 55, the pin 53*e* fixedly attached to the small-diameter shaft portion 53*d* of the inside plug 53 is stopped at the unlock position UnL-P set in the first vertical cam groove 56*b*1 in the knock cam section 56*b* formed on the inner surface of the shaft hole 56*a* of the bearing member 56 which is shown in FIG. 5B. The inside plug 53 thus stands by at the unlock position UnL-P in the socket body 51.

Next, FIG. 6(*b*) shows a state just before the insertion shaft 32 located at the pressing position in the joint body 31 pushes the inside plug 53 in the socket body 51 rearward.

Here, the respective pulse motors (not illustrated) of the joint body drive mechanism 11 and the insertion shaft drive mechanism 12 are simultaneously rotated in a forward direction from the initial positions to move forward the joint body 31 and the insertion shaft 32 together toward the socket portion 50. Then, the cap 37 attached to the distal end portion of the joint body 31 advances into the distal end annular recess portion 51*af* formed on the distal end side of the socket body 51.

Along with this, the ink supply port 51*e* side of the socket body 51 moves into the cap 37, the O-ring 36, and the O-ring holding member 35 in the joint body 31 in this order. Accordingly, the three protrusions 34*c* (FIG. 4A) formed in the ink leakage preventing member 34 are brought into contact with the outer surface of the socket body 51 forming the ink supply port 51*e*, by the biasing force of the compression spring 33 in the joint body 31.

At the same time, the distal end sharp portion 32*a* of the insertion shaft 32 located at the pressing position in the joint body 31 advances from the ink supply port 51*e* of the socket body 51 and comes into contact with the conical hole 53*a*1 formed in the first cylinder portion 53*a* of the inside plug 53 moved to a front side of the first circular recess portion 51*g*. However, the inside plug 53 is not moved rearward yet. Hence, the ink IK in the socket body 51 is sealed by the inside plug 53 and the pin 53*e* fixedly attached to the small-diameter shaft portion 53*d* of the inside plug 53 is still located at the unlock position UnL-P in the shaft hole 56*a* of the bearing member 56.

Next, FIG. 6 (*c*) shows a state where the insertion shaft 32 located at the pressing position in the joint body 31 pushes the inside plug 53 in the socket body 51 rearward against the biasing force of the compression spring 55.

Here, the respective pulse motors (not illustrated) of the joint body drive mechanism 11 and the insertion shaft drive mechanism 12 are continuously rotated in the forward direction from the state of FIG. 6(*b*) to further move the joint body 31 and the insertion shaft 32 together toward the socket portion 50. Then, the cap 37 attached to the distal end portion of the joint body 31 is moved deep into the distal end annular recess portion 51*af* formed on the distal end side of the socket body 51.

Along with this, the outer surface of the socket body 51 forming the ink supply port 51*e* pushes the three protrusions 34*c* (FIG. 4A) formed in the ink leakage preventing member 34 in the joint body 31 rearward. The compression spring 33 in the joint body 31 is thereby compressed.

Moreover, the distal end sharp portion 32*a* of the insertion shaft 32 located at the pressing position in the joint body 31 presses the conical hole 53*a*1 of the inside plug 53 housed in the socket body 51, against the biasing force the compression spring 55, and pushes the inside plug 53 to the rear side which is the opposite side to the ink supply port 51*e*. The inside plug 53 is thus moved to an inside plug pressed position set in the socket body 51.

Along with this pressing operation of the insertion shaft 32, the pin 53*e* fixedly attached to the small-diameter shaft portion 53*d* of the inside plug 53 is moved along the first vertical cam groove 56*b*1, the rightward-downward-inclined cam groove 56*b*2, the second vertical cam groove 56*b*3, and the first leftward-upward inclined cam 56*b*4 in the knock cam section 56*b* formed on the inner surface of the shaft hole 56*a* of the bearing member 56 which is shown in FIG. 5B, to be locked at the lock position L-P defined by the horizontal cam 56*b*5 and the vertical cam 56*b*6. The inside plug 53 having moved to the inside plug pressed position set in the socket body 51 is thus held at the lock position L-P in the knock cam section 56*b* formed on the inner surface of the shaft hole 56*a* of the bearing member 56.

When the pin 53*e* fixedly attached to the small-diameter shaft portion 53*d* of the inside plug 53 is locked at the lock position L-P in the shaft hole 56*a* of the bearing member 56, the ink flow-out passage 51*j* is formed in the first circular recess portion 51*g*, the tapered recess portion 51*h*, and the second circular recess portion 51*i* of the socket body 51.

Furthermore, since the inner periphery cylinder portion 51*f* of the socket body 51 is brought into contact with an inner peripheral surface of the O-ring 36 housed in the joint body 31, ink leakage in the joint body 31 can be prevented.

Next, FIG. 6(*d*) shows a state where the insertion shaft 32 retreats from the ink supply port 51*e* of the socket body 51 with the inside plug 53 being locked in the socket body 51.

Here, when the pin 53*e* fixedly attached to the small-diameter shaft portion 53*d* of the inside plug 53 is locked at the lock position L-P in the shaft hole 56*a* of the bearing member 56, the pulse motor (not illustrated) of the joint body drive mechanism 11 is stopped and the joint body 31 is maintained in the state shown in FIG. 6(*c*).

Meanwhile, immediately after the inside plug 53 is locked in the socket body 51, only the pulse motor (not illustrated) of the insertion shaft drive mechanism 12 is rotated in a reverse direction to move the insertion shaft 32 to a retreat position which is outside the ink supply port 51*e* of the socket body 51.

Here, the retreat position of the insertion shaft 32 is a position of the ink leakage preventing member 34 which is rearward of the O-ring 36 inside the cap 37 in the joint body 31.

In this case, even if the insertion shaft 32 retreats to the retreat position outside the ink supply port 51*e* of the socket body 51, the inside plug 53 is maintained in the lock state by an inside plug lock portion (L).

Due to this configuration, the insertion shaft 32 does not hinder the ink supply port 51*e* of the socket body 51 from supplying the ink IK on the socket portion 50 side to the joint portion 30 side. Hence, a large amount of ink IK in the socket body 51 can flow into the joint body 31 from the ink supply port 51*e*.

Thereafter, the ink IK having flowed into the joint body 31 is supplied to the printing machine 10 through the ink flow-in passage 31*g* formed in the joint body 31.

From the configuration described above, it is possible to reduce an ink supply time without increasing the sizes of the printing machine 10 and the ink cartridge 40 and to thereby print image information on many paper sheets P at high speed in the printing machine.

Operations of Pulling Joint Portion 30 Out from Socket Portion 50

Figure 7:
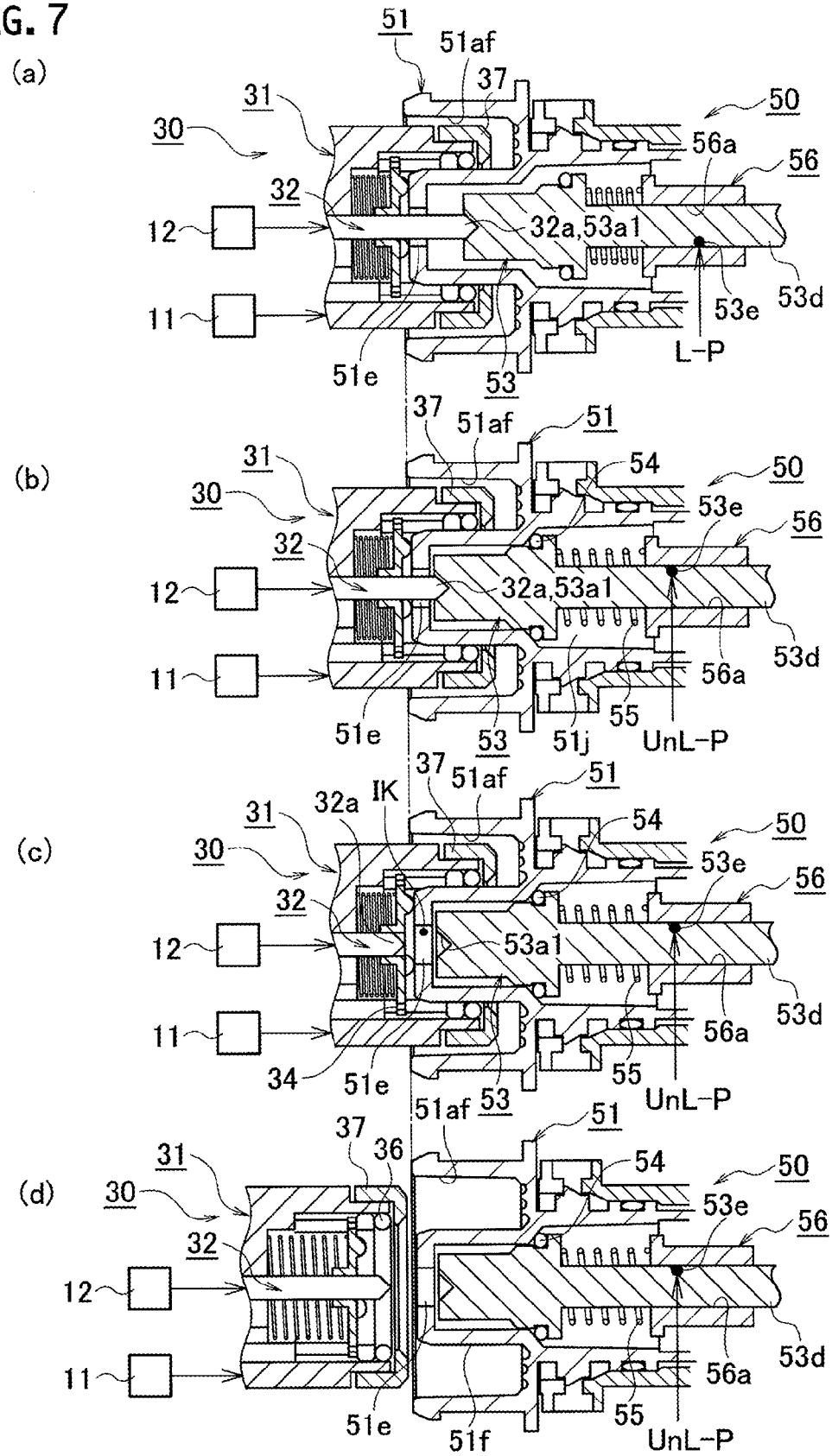
FIGS. 7(*a*) to 7(*d*) are operation views showing an operation sequence of pulling the joint portion in the printing machine out from the socket portion in the ink cartridge.

When the joint portion 30 in the printing machine 10 is to be pulled out from the socket portion 50 in the ink cartridge 40, it only necessary to perform operations shown in FIGS. 7(*a*) to 7(*d*). In this case, the insertion shaft 32 is moved to the retreat position outside the ink supply port 51*e* of the socket body 51 immediately after the inside plug 53 is unlocked.

First, the state shown in FIG. 7(*a*) is a state where the insertion shaft 32 having retreated to the retreat position in the joint body 31 outside the ink supply port 51*e* of the socket body 51 is moved again toward the ink supply port 51*e* and the inside plug 53 locked in the socket body 51 is thereby pressed again.

Specifically, the joint body drive mechanism 11 is not operated and the cap 37 attached to the distal end of the joint body 31 of the joint portion 30 is left to be disposed deep in the distal end annular recess portion 51*af* of the socket body 51. Moreover, the inside plug 53 in the socket body 51 is disposed at the inside plug pressed position set in the socket body 51 and the pin 53*e* fixedly attached to the small-diameter shaft portion 53*d* of the inside plug 53 is locked at the lock position L-P in the knock cam section 56*b* formed on the inner surface of the shaft hole 56*a* of the bearing member 56.

The joint portion 30 and the socket portion 50 are thus maintained in the same state as that described above in FIG. 6(*d*).

Here, when the pulse motor (not illustrated) of the insertion shaft drive mechanism 12 is rotated again in the forward direction in the state where the insertion shaft 32 is disposed at the retreat position outside the ink supply port 51*e* of the socket body 51 as shown in FIG. 6(*d*), the insertion shaft 32 is moved again toward the ink supply port 51*e* to the pressing position in the joint body 31.

Then, the distal end sharp portion 32*a* of the insertion shaft 32 moved again to the pressing position in the joint body 31 presses the conical hole 53*a*1 of the locked inside plug 53 again through the ink supply port 51*e* of the socket body 51.

Along with the pressing operation of the insertion shaft 32 performed again, the pin 53*e* fixedly attached to the small-diameter shaft portion 53*d* of the inside plug 53 moves downward from the lock position L-P defined by the horizontal cam 56*b*5 and the vertical cam 56*b*6 in the knock cam section 56*b* formed on the inner surface of the shaft hole 56*a* of the bearing member 56 which is shown in FIG. 5B.

Next, in the state shown in FIG. 7(*b*), the inside plug 53 in the socket body 51 is unlocked by the pressing operation of the insertion shaft 32 performed again. Meanwhile, the cap 37 attached to the distal end of the joint body 31 of the joint portion 30 is still located deep in the distal end annular recess portion 51*af* of the socket body 51 as in the state shown in FIG. 7 (*a*).

Here, only the pulse motor (not illustrated) in the insertion shaft drive mechanism 12 is rotated in the reverse direction after the insertion shaft 32 presses the inside plug 53 again, and only the insertion shaft 32 is moved in a direction toward the retreat position in the joint body 31. However, the distal end sharp portion 32*a* of the insertion shaft 32 is still in contact with the conical hole 53*a*1 of the inside plug 53.

Then, along with the movement of the insertion shaft 32 in the direction toward the retreat position, the inside plug 53 to which the O-ring 54 is fitted is moved forward in the socket body 51 by the biasing force of the compression spring 55 and plugs the ink supply port 51*e*, thereby sealing the ink flow-out passage 51*j*.

Moreover, along with the forward movement of the inside plug 53, the pin 53*e* fixedly attached to the small-diameter shaft portion 53*d* of the inside plug 53 is moved downward to the saw tooth cam 56*b*8 in the knock cam section 56*b* formed on the inner surface of the shaft hole 56*a* of the bearing member 56 shown in FIG. 5B, and is then moved upward while rotating along the saw tooth cam 56*b*8. Thereafter, the pin 53*e* is moved upward via the leftward-upward-inclined cam 56*b*7 to the adjacent second vertical cam groove 56*b*3, to the adjacent rightward-downward-inclined cam groove 56*b*2, and to the adjacent first vertical cam groove 56*b*1, and is disposed at the unlock position UnL-P in the adjacent first vertical cam groove 56*b*1.

Pressing the inside plug 53 in the locked state again by the insertion shaft 32 thus causes the inside plug 53 to be unlocked and disposed at the unlock position UnL-P.

At this time, the distal end sharp portion 32*a* of the insertion shaft 32 is still in contact with the bottom portion of the conical hole 53*a*1 of the inside plug 53 by the biasing force of the compression spring 55.

Next, in the state shown in FIG. 7(*c*), the insertion shaft 32 retreats from the ink supply port 51*e* of the socket body 51 immediately after the inside plug 53 is unlocked. Meanwhile, the cap 37 attached to the distal end of the joint body 31 of the joint portion 30 is still located deep in the distal end annular recess portion 51*af* of the socket body 51 as similar to the states shown in FIGS. 7(*a*) and 7(*b*).

Here, since the inside plug 53 has been unlocked in the socket body 51 and already moved forward in the socket body 51, no ink IK in the socket body 51 leaks from the ink supply port 51*e* of the socket body 51. However, the ink IK remains near the ink supply port 51*e*.

For this reason, only the pulse motor (not illustrated) of the insertion shaft drive mechanism 12 is continuously rotated in the reverse direction from the state of the FIG. 7(*b*) immediately after the inside plug 53 is unlocked in the socket body 51, and the insertion shaft 32 is thereby moved to the retreat position outside the ink supply port 51*e* of the socket body 51. At this time, the distal end sharp portion 32*a* of the insertion shaft 32 retreats to the position of the ink leakage preventing member 34 in the joint body 31 and is disposed at the retreat position.

As a result, the ink IK near the ink supply port 51*e* of the socket body 51 is moved into the joint body 31 together with the insertion shaft 32.

Next, the state shown in FIG. 7(*d*) is a state where the fitting between the joint portion 30 and the socket portion 50 is released.

Specifically, after the insertion shaft 32 is moved to the retreat position outside the ink supply port 51*e* of the socket body 51, the pulse motor (not illustrated) of the joint body drive mechanism 11 is rotated in the reverse direction, and the cap 37 attached to the distal end of the joint body 31 of the joint portion 30 is pulled out from the distal end annular recess portion 51*af* of the socket body 51.

Then, since the O-ring 36 provided in the joint body 31 is moved away from the inner periphery cylinder portion 51*f* formed on the inner peripheral distal end side of the socket body 51, the fitting between the joint portion 30 and the socket portion 50 are released and the socket body 51 side of the joint portion 30 first returns to the initial state shown in FIG. 6 (*a*).

Along with this, the insertion shaft 32 of the joint portion 30 also returns first to the initial state shown in FIG. 6 (*a*) by being moved by the insertion shaft drive mechanism 12 to the initial position (pressing position) in the joint body 31.

In the case of releasing the fitting between the joint portion 30 and the socket portion 50 as described above, the capacity in the joint body 31 gradually increases in transition from the state of FIG. 7(*b*) to the state of FIG. 7(*c*) and then to the state of FIG. 7(*d*). Since the joint body 31 and the insertion shaft 32 are formed as separate bodies in the embodiment, the joint body 31 and the insertion shaft 32 can be independently pulled out from the socket body 51 side after the ink supply port 51*e* of the socket body 51 is completely sealed by the inside plug 53. The ink IK in the socket body 51 thus does not leak from the ink supply port 51*e* of the socket body 51.

Unlike the above description, in the ink cartridge mount/demount mechanism described in Patent Document 1 explained above in the related art, the joint body and the insertion shaft are integrally formed. Accordingly, the inside plug in the socket body is gradually moved in such a direction that the ink supply port is sealed, along with the movement of pulling an integral body of the joint body and the insertion shaft out from the socket body. Hence, there is such a risk that the ink on the socket body side may leak due to a negative pressure generated by the gradual increase of the capacity in the joint body before the ink supply port is completely sealed by the inside plug. However, as described above, in the embodiment, there is no risk of leakage of the ink IK on the socket body 51 side.

In this case, as described in FIG. 7(*c*), the ink IK near the ink supply port 51*e* of the socket body 51 is transferred to the joint body 31 by the retreat of the insertion shaft 32 from the ink supply port 51*e*. Accordingly, the amount of ink which may drip between the joint portion 30 and the socket portion 50 can be suppressed to the minimum. Hence, it is possible to suppress the dripping of the ink IK from the ink supply port 51*e* which occurs when the fitting between the joint portion 30 and the socket portion 50 is released.

The ink cartridge 40 can be thus carried at ease after being detached from the printing machine 10.

Regarding the ink cartridge 40 and the ink cartridge mount/demount mechanism M/DeM in the embodiment described above in detail, description is given of the example in which the joint body 31 of the joint portion 30 is moved by the joint body drive mechanism 11 in the front-rear directions relative to the socket portion 50 when the socket portion 50 is fitted to and pulled out from the joint portion 30.

However, the present invention not limited to the example described above. Alternatively, the ink cartridge 40 and the ink cartridge mount/demount mechanism M/DeM may be configured such that the joint body 31 of the joint portion 30 is fixedly installed in the holder 21 in the printing machine 10 and the socket body 51 of the socket portion 50 of the ink cartridge is manually attached to and detached from the fixedly-installed joint body 31.

In this case, no joint body drive mechanism 11 is required but the insertion shaft drive mechanism 12 is required. It is only necessary that the insertion shaft drive mechanism 12 causes the insertion shaft 32 to retreat from the ink supply port 51*e* of the socket body 51 in each of the states shown in FIGS. 6(*d*) and 7(*c*).

Moreover, description is given of the example in which the inside plug lock/unlock portion L/UnL forming the main portion of the embodiment is formed of: the pin 53*e* fixedly attached to the intermediate portion of the small-diameter shaft portion 53*d* of the inside plug 53 moved by being pressed by the insertion shaft 32; and the knock cam sections 56*b* formed on the inner surface of the shaft hole 56*a* of the bearing member 56.

However, the present invention is not limited to the example described above and the inside plug lock/unlock portion L/UnL may employ any structural form as long as the inside plug 53 moved by being pressed by the insertion shaft 32 can be locked and unlocked.

For example, as another example of the inside plug lock/unlock portion L/UnL, the inside plug can be locked and unlocked in the following configuration. The inside plug is provided to be capable of being linearly moved along a key groove formed in a shaft hole of the bearing member by using a guide key fixedly attached to a lower end side of the small-diameter shaft portion, and the pin is fixedly attached to the intermediate portion of the small-diameter shaft portion of the inside plug. Furthermore, a rotating cam body is provided between the bearing member and the compression spring biasing the inside plug, and the knock cam section is formed on an inner surface of a shaft hole of the rotating cam body to engage with the pin described above.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An ink cartridge comprising:

an ink storage container configured to store ink;

a socket portion provided at one end of the ink storage container and configured to be fitted to and detached from a joint portion of a printing machine;

an ink supply port provided in the socket portion;

an inside plug configured to seal an ink passage to the ink supply port by using a biasing force coming from a direction of the ink storage container; and an inside plug lock portion configured to lock the inside plug at a position where the inside plug is pressed by an insertion shaft, and maintain a locked state of the inside plug independently of a retreating of the insertion shaft to a retreat position after a locking of the inside plug, the insertion shaft being capable of advancing and retreating between a pressing portion and the retreat portion, the pressing portion being a position where the insertion shaft presses the inside plug against the biasing force and thereby unseals the ink passage when the socket portion and the joint portion are fitted to each other, the retreat position being a position where the insertion shaft retreats to outside of the ink supply port.

2. The ink cartridge according to claim 1, wherein the inside plug lock portion is configured to release the locked state of the inside plug upon the inside plug in the locked state being pressed again, and before the ink cartridge is pulled out from the printing machine, the ink passage is sealed with the inside plug by moving the insertion shaft to the pressing position to unlock the inside plug, and then by moving the insertion shaft toward the retreat position.

3. The ink cartridge according to claim 1, wherein the socket portion is configured to be fitted to and detached from the joint portion of the printing machine having the insertion shaft and a slide-contact member in a distal end recess portion of a joint body of the joint portion, the ink storage container is attached to a rear end side of the socket portion, the ink supply port is provided in a side of the socket portion corresponding to the distal end recess portion, the socket portion comprises an inner periphery cylinder portion defined in an outer periphery of the ink supply port and is configured to be fitted to the joint portion by entering the distal end recess portion and slidingly contacting the slide-contact member, and the inside plug lock portion is configured to lock the inside plug while pressing the inside plug at the position where the inside plug is pressed by the insertion shaft, and maintain the locked state of the inside plug while keeping the ink supply port fully open independently of the retreating of the insertion shaft to the retreat position after the locking of the inside plug.

4. The ink cartridge according to claim 1, wherein the inside plug lock portion is configured to release the locked state of the inside plug upon the inside plug in the locked state being pressed again, and before the ink cartridge is pulled out from the printing machine, the ink passage is sealed with the inside plug by moving the insertion shaft to the pressing position to unlock the inside plug, and then by moving the insertion shaft toward the retreat position, and, after the ink passage is sealed, the insertion shaft is retreated to the retreat position and then a fitting of the joint portion and the socket portion is released.

5. An ink cartridge mount/demount mechanism comprising:

a joint portion provided in a printing machine; and a socket portion provided on a distal end side of an ink cartridge, the joint portion and the socket portion configured such that the socket portion is detachably fitted to the joint portion and ink in an ink storage container attached to a rear end side of the socket portion is supplied to the printing machine from the socket portion via the joint portion, wherein the joint portion includes:

a joint body provided to face the socket portion; and an insertion shaft capable of advancing and retreating between a pressing position of pressing the socket portion by protruding forward in the joint body and a retreat position retreating to a position rearward of the pressing position, and the socket portion including:

a socket body including an ink supply port on a side of the socket body facing the joint body;

an inside plug housed in the socket body to seal an ink passage to the ink supply port by using a biasing force coming from a direction of the ink storage container and configured to unseal the ink passage by staying at a position where the inside plug is pressed by the insertion shaft at the pressing position against the biasing force when the socket portion is fitted to the joint body; and an inside plug lock portion configured to lock the inside plug at the position where the inside plug is pressed by the insertion shaft, and maintain a locked state of the inside plug independently of a retreating of the insertion shaft to a retreat position outside of the ink supply port after a locking of the inside plug.

6. The ink cartridge mount/demount mechanism according to claim 5, wherein the inside plug lock portion is configured to release the locked state of the inside plug upon the inside plug in the locked state being pressed again, and before the ink cartridge is pulled out from the printing machine, the ink passage is sealed with the inside plug by moving the insertion shaft to the pressing position to unlock the inside plug, and then by moving the insertion shaft in a direction toward the retreat position.

7. The ink cartridge mount/demount mechanism according to claim 5, wherein the joint body comprises a distal end recess portion provided to face the socket portion, the joint portion comprises a slide-contact member provided in the distal end recess portion, the ink supply port is provided in a side of the socket portion corresponding to the distal end recess portion, the socket portion comprises an inner periphery cylinder portion defined in an outer periphery of the ink supply port and is configured to be fitted to the joint portion by entering the distal end recess portion and slidingly contacting the slide-contact member, and the inside plug lock portion is configured to lock the inside plug while pressing the inside plug at the position where the inside plug is pressed by the insertion shaft, and maintain the locked state of the inside plug while keeping the ink supply port fully open independently of the retreating of the insertion shaft to the retreat position after the locking of the inside plug.

8. The ink cartridge mount/demount mechanism according to claim 5, wherein the inside plug lock portion is configured to release the locked state of the inside plug upon the inside plug in the locked state being pressed again, and before the ink cartridge is pulled out from the printing machine, the ink passage is sealed with the inside plug by moving the insertion shaft to the pressing position to unlock the inside plug, and then by moving the insertion shaft toward the retreat position, and, after the ink passage is sealed, the insertion shaft is retreated to the retreat position and then a fitting of the joint portion and the socket portion is released.

* * * * *